US006970801B2

(12) United States Patent
Mann

(10) Patent No.: US 6,970,801 B2
(45) Date of Patent: Nov. 29, 2005

(54) CONTROL SYSTEM OR PROCESS FOR THE AUTOMATIC CONTROL OF A MOVEABLE BUCKET WHEEL DEVICE

(75) Inventor: Bernd Mann, Mulheim (DE)

(73) Assignee: ISAM Holding GmbH, Mulheim (DE)

( * ) Notice: Subject to any disclaimer, the term of this patent is extended or adjusted under 35 U.S.C. 154(b) by 225 days.

(21) Appl. No.: 10/284,689

(22) Filed: Oct. 31, 2002

(65) Prior Publication Data

Related U.S. Application Data

(63) Continuation of application No. PCT/DE01/01637, filed on May 2, 2001.

(30) Foreign Application Priority Data

May 5, 2000 (DE) ..... 100 21 675

(51) Int. Cl.[7] ..... G01C 17/00
(52) U.S. Cl. ..... 702/150; 250/233 R; 37/414
(58) Field of Search ..... 702/150; 250/233 R; 37/414

(56) References Cited

U.S. PATENT DOCUMENTS

| | | | | |
|---|---|---|---|---|
| 4,507,910 | A | 4/1985 | Thornley et al. | 56/10.2 |
| 5,883,817 | A | 3/1999 | Chisholm et al. | 364/578 |
| 6,363,632 | B1 * | 4/2002 | Stentz et al. | 37/414 |
| 6,369,376 | B1 * | 4/2002 | Gerlach | 250/223 R |

FOREIGN PATENT DOCUMENTS

| | | | |
|---|---|---|---|
| DE | 4133392 | C | 12/1992 |
| DE | 197 37 858 | A | 1/1999 |
| EP | 0412 400 | | 7/1990 |
| EP | 0412 400 | A1 | 7/1990 |
| EP | 0412 402 | A | 2/1991 |
| EP | A-0159187 | | 11/2002 |
| JP | 54042801 | A | 4/1979 |

OTHER PUBLICATIONS

Patent Abstracts of Japan JP 57 146105A, vol. 006, No. 248 (P-160), Dec. 7, 1982.
Patent Abstract of Japan JP 59 106634A, vol. 008, No. 224, Oct. 13, 1984.
Patent Abstracts of Japan JP 58 052119A, vol. 007, No. 137, Jun. 15, 1983.
Patent Abstracts of Japan JP 57209124A, vol. 007, No. 068, Mar. 19, 1983.
Entgegenhaltung 4DE-Zeitschrift baumaschiaendienst heft 10, 1998, pp. 14-19.

* cited by examiner

*Primary Examiner*—John Barlow
*Assistant Examiner*—Stephen J. Cherry
(74) *Attorney, Agent, or Firm*—Nash & Titus, LLC; Caroline Nash

(57) ABSTRACT

A control system, or process for the automatic control of a moveable bucket wheel device for the reducing of a stockpile and/or for the piling up of bulk goods, whereby the bucket wheel device has a least one bucket wheel for the takeup of bulk goods, at least one measurement device for the measurement of the stockpile and the bucket wheel device is automatically moved to the desired removal and/or piling up position in dependence of the measured and/or processed measurement data. Natural slide processes on the stockpile can be determined in that the control system and the measurement device are constructed or realized in such a way that a continual capture of the actual stockpile shape is guaranteed independent of the operation of the bucket wheel shovel namely an actual change of the stockpile shape can be captured at least in a certain vicinity of the bucket wheel.

16 Claims, 4 Drawing Sheets

Figure 1:
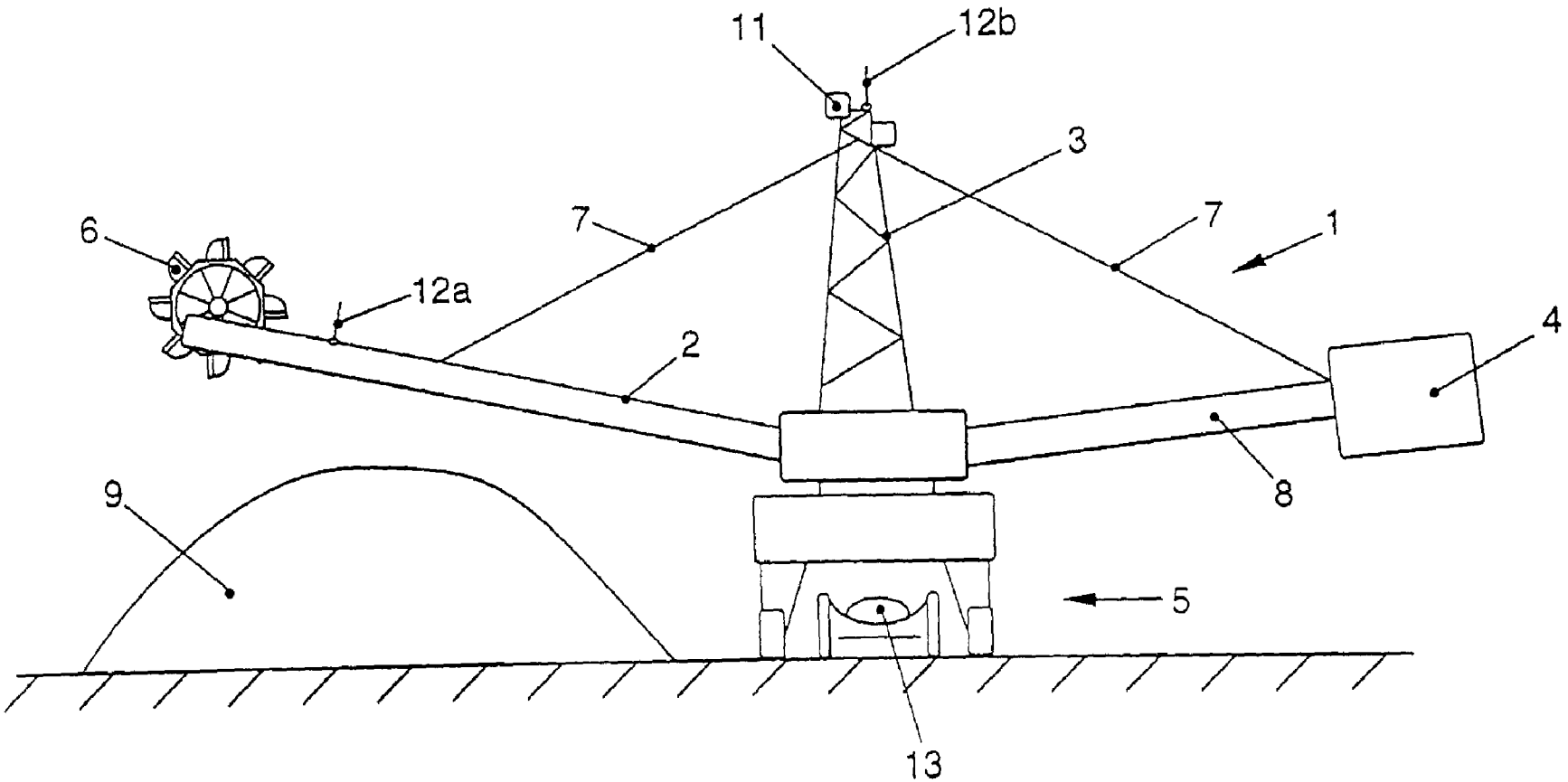

CONTROL SYSTEM OR PROCESS FOR THE AUTOMATIC CONTROL OF A MOVEABLE BUCKET WHEEL DEVICE

This application is a continuation of PCT Application No. PCT/DE01/01637 filed on May 2, 2001, pending.

The invention relates to a control system for the automatic control of a moveable bucket wheel device for the reducing of stockpiles and/or for the piling up of bulk goods, whereby the bucket wheel device includes at least one bucket wheel for takeup of the bulk goods, at least one measuring device for measuring the stockpile is provided and the bucket wheel device is automatically moveable up to the desired reducing and/or piling up position independent of the measured and/or processed measurement data. The invention further relates to a process for the automatic control of a moveable bucket wheel device, especially by way of the above mentioned control system, whereby an automatic control of a moveable bucket wheel device is carried out for the reducing of stockpiles and/or the piling up of bulk goods, whereby the shape of the stockpile is captured by way of at least one measuring device, and the bucket wheel device is automatically moved to the desired reducing and/or piling up position independent of the measured and/or processed measurement data.

Especially inventory and pass-through time optimized storage and transport systems are essential prerequisites for modern and flexible bulk goods transloading installations. Cost efficient and future oriented solutions take into consideration especially the integration into the automation technology so that during the later operation a cost efficient and simple handling can be realized. It must be especially considered hereby, that bucket wheel devices generally operate in three-shift operation whereby upon a manual control of such a bucket wheel device corresponding salaries must be paid by the employer so that the operation of such a bucket wheel device is connected with high cost.

A bucket wheel device is known in the art on which this invention is based (DE 197 37 858 A1), and which is constructed for the reducing especially of compressed stockpiles or for the piling up of bulk goods. The bucket wheel device also called "bucket wheel shovel", has a forward jib at the forward end of which is the bucket wheel, and a pylon which constructed like a tower. Finally, a counterweight is provided which is positioned at the side of the pylon opposite the forward jib, namely on a rearward jib. The forward region of the forward jib is connected past the upper portion of the pylon with the counterweight through supporting cable-type elements. The forces occurring during the loading of the bucket wheel with bulk goods at the forward jib or at the bucket wheel device are correspondingly compensated through the counterweight. The known bucket wheel device described here has a control system for the automatic control of the moveable bucket wheel device. A measuring device for the measuring of the stockpile shape, namely the surface profile of the stockpile is provided. Since the bucket wheel device itself is moveably constructed, which means it has a corresponding drive system, the bucket wheel device is moved to the desired reducing and/or piling up position independent of the measured and/or processed data determined by the measuring device and preferably in such a way that the bucket wheel positioned at the forward end of the forward jib is positioned at the desired reducing or piling up position. Thus, the bucket wheel device itself is moved on the one hand, while on the other hand the forward jib of the bucket wheel device is moved in such a way that the bucket wheel is positioned at the desired height position and at the desired lateral position for the reducing or piling up of the stockpile.

Depending on the surface profile of the stockpile, which is determined or calculated by way of the measuring device, the bucket wheel device known in the art is correspondingly moved, or individually moveable components of the bucket wheel device, which are, for example, referred to as combi-devices, are moved. The measurement device used is constructed as a 2-D scanner and scans the surface of the stockpile. The measuring device is positioned at the forward region of the forward jib of the bucket wheel device. In order that the stockpile shape, which means the surface profile of the stockpile, can be determined, the known bucket wheel device must be moved along the stockpile, whereby the forward jib as it were "passes over" the stockpile and the measurement device scans the surface during the passage over the stockpile. Consequently, before commencement of operations, the known bucket wheel device initially carries out a separate measurement pass. The position of the measuring device can be determined, among others, by way of the distance of travel of the bucket wheel device, the position of the lifting mechanism, the swivel mechanism, as well as the travel mechanism, the respective positions of which are determined by separately provided angle sensors or separate sensors. This measurement device scans the stockpile shape during the measurement pass. In other words, a 3-D stockpile model is calculated by way of a control device or a plug-in PC from the measured data of the measurement device and the measured data of the angle sensors provided at the traveling, rotating and lifting mechanism and by way of a 2-D converter. During the operation of the bucket wheel device, which means during the piling up or reducing of the stockpile, the separately provided control continuously interrogates the values of the angle sensors as well as conveyor belt scale data for the transported off, which means reduced, bulk goods. On the basis of these values, the control then calculates a provisional stockpile model which is continuously updated according to the measured reduced amount of the bulk goods or the piled up amount so that preferably no separate measurement passes need to be carried out with the bucket wheel device in order to determine the surface profile of the stockpile. In other words, in the bucket wheel device of the prior art or in the process described therein, the stockpile shape is first initially determined by way of a measurement pass of the bucket wheel device and the 2-D scanner, whereby thereafter the reducing or piling up process is initiated and the control then calculates a provisional stockpile model through corresponding measurement values, especially the angle sensor signals as well as amount values for the reduced or piled up bulk goods.

The control system in accordance with the prior art or the known process for the automatic control of a bucket wheel device is not yet optimally constructed. On the one hand a measurement pass of the bucket wheel device or also a combi-device is always at least initially necessary for the capture or determination of the stockpile shape, since the measurement device positioned in the region of the forward jib must be passed over the stockpile according to the length of the stockpile so that the provided 2-D scanner can capture the stockpile shape. During this measurement pass, the movement of the whole bucket wheel device, especially the movement of the traveling, lifting and swiveling mechanism, preferably by way of the angle sensors, in effect the movement of the bucket wheel device about its two axes of rotation as well as the movement of the bucket wheel device preferably along a track along the stockpile must be continually determined by separate sensors which measure the distance traveled, in order that the position of the measurement device can be determined on the one hand and the stockpile shape or the stockpile model can then be calculated from the measured data on the other hand. In order to then pile up or reduce the corresponding stockpile, the bucket wheel device is then automatically moved to the desired reducing and/or piling up position so that the bucket wheel of the bucket wheel device commences, for example, with the reducing of the stockpile and that based on the "captured stockpile model" stored in the control unit. This stockpile model is then updated by way of further measurement data which are determined, especially the bulk goods amount (for example amount of mineral coal) arriving at the conveyor installation or transported away by the conveyor installation is captured, and thereby the conveyor scale measurement values, by corresponding sensors, and the stockpile model stored in the control unit is then continuously updated by way of these measurement data. In other words, during the operation of the bucket wheel device, especially in a certain region in the vicinity of the bucket wheel, no separate measurement of the stockpile shape is carried out. The control of the removal of the stockpile is therefor carried out on the basis of the continuously updated theoretical "stockpile model". This is associated with several disadvantages. On the one hand, changes of the stockpile shape can occur during the operation of the bucket wheel device, for example, during rainfall because of natural downslide processes or the like. Furthermore, slides or downslides can be triggered by the removal process itself. In the end, an actual changing stockpile shape cannot be immediately detected with the known control system, and can especially not be detected when, for example, the bucket wheel device stands still, which means is not operated, since then no passing of the measurement device over the stockpile occurs. Because of the changing stockpile shape, especially because of natural downslide processes, it can happen that the bucket wheel of the bucket wheel device, for example, takes up a starting position which is not optimal. This harbors problems for the corresponding hydraulic system or also for the bucket wheel device itself (danger of tipping over). In the end, the known process or the known control system is here not optimal, since during the operation of the bucket wheel device, a downslide of certain portions of the stockpile, for example, cannot be detected.

It is therefore an object of the invention to construct and further develop the above mentioned control system or the above mentioned process in such a way that the control of a bucket wheel device is optimized, especially the positioning of the bucket wheel, preferably by avoiding these dangers, and the required initial measurement pass of the bucket wheel device for the detection of the stockpile shapes.

For the control system, the above mentioned object is now achieved in that the control system and a measurement device are constructed or realized in such a way that a permanent detection of the actual stockpile shape is guaranteed independent of the operation of the bucket wheel device, so that an actual change in the stockpile shape is detectable at least in a certain region in the vicinity of the bucket wheel.

For the initially mentioned process, the above-mentioned object is achieved in that a permanent detection of the actual stockpile shape is carried out independent of the operation of the bucket wheel device, in that an actual change in the stockpile shape is detected at least in a certain region in the vicinity of the bucket wheel.

By constructing the control system or the process in such a way that a permanent detection of the actual stockpile shape is guaranteed, changes in the stockpile shape which are caused by, for example, natural occurrences such as "downslide during rain" can always actually be detected. The detection of these changes of the actual stockpile shape is required and practical especially in a certain region in the vicinity of the bucket wheel so that the bucket wheel can always be moved into the exact and desired position. This prevents the above-mentioned dangers. Furthermore, separate measurement passes, especially the initial measurement pass so far required in the prior art, are avoided, since the actual stockpile shape can be captured independent of the operation of the bucket wheel device. Therefore, the calculation is obviated of the provisional "stockpile model" known in the art in dependence of the determination of the bulk goods weight transported off. As a result, the above-described disadvantages are avoided which will be apparent in detail further below.

A multitude of possibilities exist for the advantageous construction and further development of the control system in accordance with the invention, or the process of the invention for the control of the bucket wheel device. A preferred exemplary embodiment of the invention is described in the following by way of the following drawing and the associated description. In the drawing, it shows FIG. 1 a moveable bucket wheel device in schematical side illustration, FIG. 2 a hardware configuration for the realization of the control system in accordance with the invention, or the process in accordance with the invention for the bucket wheel device illustrated in FIG. 1, FIG. 3 a hardware configuration for the realization of the control system in accordance with the invention, or the process in accordance with the invention in detailed schematic illustration, and FIG. 4 a screen surface with the illustration of a detected stockpile surface profile.

Figure 3:
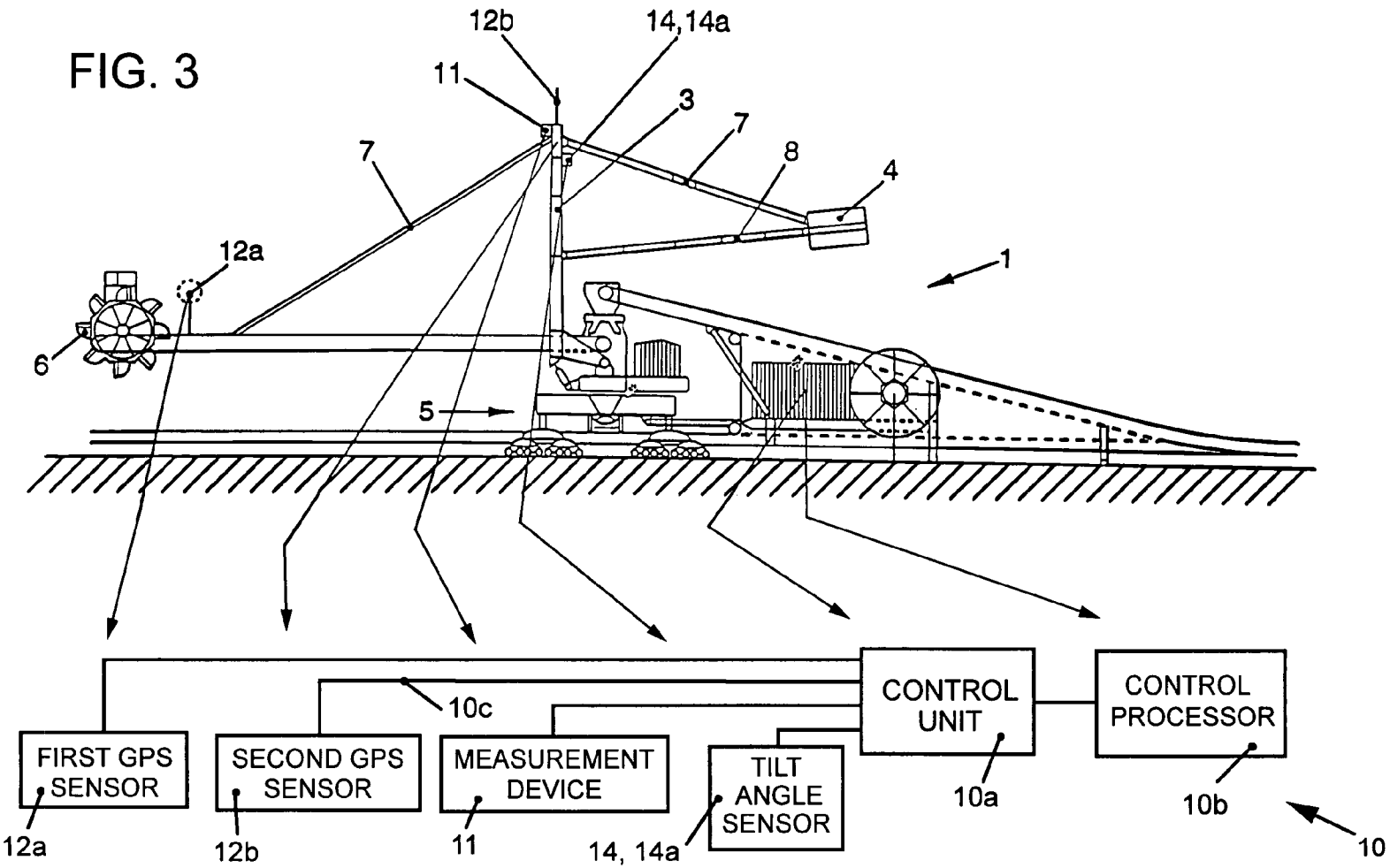

FIGS. 1 and 3 show a bucket wheel device 1 which has a forward jib 2, a pylon 3, a counterweight 4 and a travel mechanism 5. A bucket wheel 6 is additionally provided at a forward end of the jib 2. The upper portion of the bucket wheel device 1, which means the jib 2, the pylon 3 as well as the counterweight 4 and the rearward jib 8 are on the one hand connected by supporting cables 7 with one another and on the other hand constructed in such a way that this part of the bucket wheel device 1 is swivelable on the travel mechanism 5 and rotatable. The angles between the pylon 3 and the forward jib 2 as well as between the pylon 3 and the rearward jib 8 thereby remain constant. The reducing of bulk goods from a stockpile 9 or the piling up of bulk goods into a stockpile 9 is carried out by way of the bucket wheel 6 positioned at the forward jib 2. The conveyor belt 13 for the transport of the bulk goods is apparent.

The bucket wheel device 1 hereby has a control system 10 for the automatic control of the moveable bucket wheel device 1. It is apparent from FIG. 1, that the bucket wheel device 1 can be moved along the stockpile 9. The bucket wheel device 1 automatically moves to a reducing or piling up position and automatically removes the bulk goods or automatically piles them up. The movement of the bucket wheel device 1 as well as the control of the bucket wheel 6 and also the swiveling and/or rotation of the upper part of the bucket wheel device 1 is carried out in dependence of the stockpile shape, especially the surface profile of the stockpile 9. At least one measuring device 11 is provided for the measuring for the stockpile 9. By way of the control system 10 and the measurement data measured by the measurement device 11, the bucket wheel device 1 is then automatically moved to the desired reducing and/or piling up position, and especially the bucket wheel 6 is accordingly positioned.

The above mentioned disadvantages are now avoided in that the control system 10 and the measurement device 11 are constructed or realized in such a way that a continual detection of the actual stockpile shape is guaranteed independent of the operation of the bucket wheel device 1, namely in that an actual change of the stockpile shape can be detected at least in a certain region in the vicinity of the bucket wheel 6. Therefore—according to the process of the invention—a continual detection of the actual stockpile shape is guaranteed and thereby an actual change in the stockpile shape detected—at least in a certain region in the vicinity of the bucket wheel 6—independent of the operation of the bucket wheel device 1. Because of the continual detection of the stockpile shape, which corresponds to the actual situation, changes of the stockpile shape which are especially not directly linked with a reducing or a piling up of bulk goods, for example, based on natural downslides, can be immediately detected since the stockpile shape is continually, which means also continuously, scanned. On the basis thereof, the bucket wheel 6 can always be optimally positioned at the desired piling up or reducing position. While in the prior art scale measurement values of the bulk goods removed by way of the conveyor belt had to be determined and the provisional "stockpile model" calculated therefrom, the components required therefor in this control effort are obviated, or a more exact control is now possible by way of the control system or process in accordance with the invention.

As is readily apparent from FIGS. 1 and 3, the measurement device 11 is provided at the pylon 3 and in particular at the upper end of the pylon 3. The measuring device 11 used herein is constructed as a 3-D image capturing system, especially as a 3-D laser scanner. For example, a so-called "3-D imaging sensor LMS-210" is applicable which can scan the stockpile shape within a range of preferably up to 350 meters.

Furthermore, a GPS system (global positioning system) is provided for the detection of the movements and/or positions of the bucket wheel device 1 or the corresponding components, namely the jibs 2 and 8 or the pylon 3 and the bucket wheel 6. The movements of the bucket wheel device 1 about its 3 axis of rotation can be most exactly determined on the basis of this GPS system. First and second GPS position receivers 12*a* and 12*b*, which are constructed as simple GPS antennae, are here provided for the determination of the position of the bucket wheel device 1 as well as the determination of the position of the corresponding bucket wheel device components. The first GPS position receiver 12*a* is provided at the forward jib 2 and the second position receiver 12*b* at the pylon 3. The GPS position receivers 12*a* and 12*b* are preferably realized as CFD (Carrier Face Differential) receivers.

Figure 2:
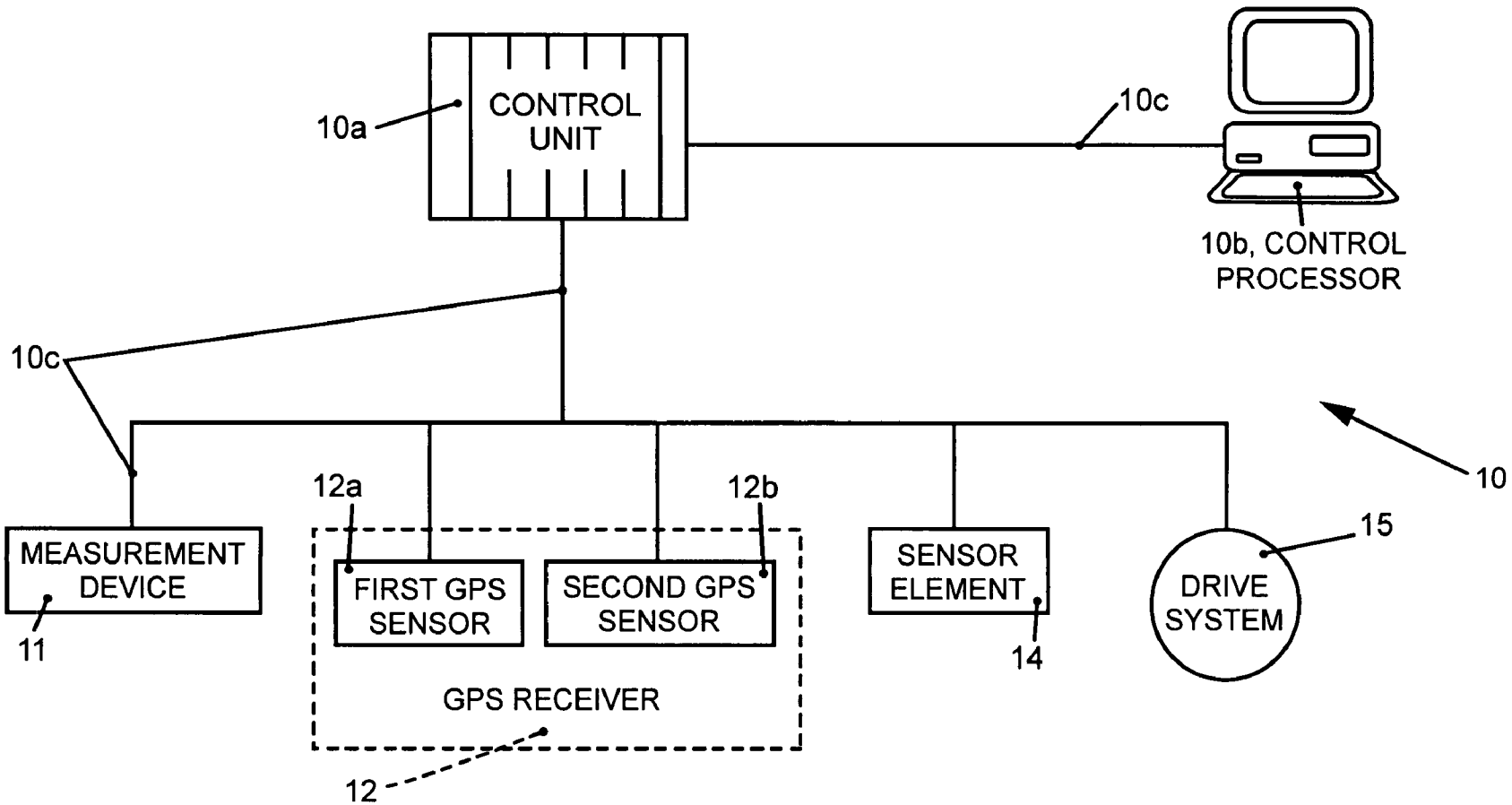

As is apparent from FIGS. 2 and 3, the bucket wheel device 1 has a separate control processor 10*b*. Furthermore, the control system 10 includes additional sensor elements 14 for the realization of an additional tipping protection for the bucket wheel device 1. This includes especially a tilt angle sensor 14*a* which is also positioned at the upper end of the pylon 3 just like the second GPS position receiver 12*b*.

FIG. 2 now shows a hardware configuration for the control system 10 for the bucket wheel device 1. As already mentioned, a travel mechanism 5 is provided for the positioning of the bucket wheel device 1 as well as—as is apparent from FIG. 3—a not further described lifting mechanism and a swivel mechanism, so that the swiveling or rotation of the upper part of the bucket wheel device 1, i.e. of the forward jib 2 and pylon 3 as well as the rearward jib 4 is possible. The drive system 15 herefor provided is only schematically illustrated in FIG. 2.

FIG. 2 shows, however, that the drive system 15 is adjusted or controlled by a control unit 10*a* in dependence of the measurement data of the measurement device 11 as well as the data determined by the GPS system. The nominal values for the control of the bucket wheel device 1 are calculated in the control unit 10*a*. In dependence of the measurement data of the measurement device 11, the control unit 10 determines the stockpile shape of the stockpile 9, especially the surface profile of the stockpile 9 from which bulk goods are to be removed or onto which bulk goods are to be piled. A control processor 10*b* is provided in support of the control unit 10*a*, which determines the position of the bucket wheel device 1 as well as the bucket wheel 6 especially from the data detected by the GPS position receivers 12*a* and 12*b*. One can here recall, that although the portion of the bucket wheel device 1 is arranged to swivel and rotate, namely swivel and rotate on the travel mechanism 5, the positioning of the pylon 3 relative to the forward jib 2 or the rearward jib 8 is always the same, which means the corresponding distances and angles remain, since it represents a unit of the bucket wheel device 1 which does not change. Because of the known dimensions, the exact location or position of the bucket wheel device and the associated components can always be determined by way of the two GPS position receivers, namely the first GPS position receiver 12*a* and the second GPS position receiver 12*b*. The two GPS position receivers 12*a* and 12*b* are herefor preferably positioned in one and the same plane, but fastened or fixed at different locations, here at the forward jib 2 and at the pylon 3.

FIG. 3 shows a detailed illustration of a hardware configuration for the bucket wheel device 1. It is well apparent that the measurement device 11 and the second GPS position receiver 12*b* are positioned at the upper end of the pylon 3 of the bucket wheel device 1. The first GPS position receiver 12*a* is positioned at the forward jib 2 of the bucket wheel device 1. It is conceivable that in addition to the first GPS position receiver 12*a*, a video camera system is additionally positioned, namely shortly behind the bucket wheel 6, which, for example, can be connected with an external control center. However, this is here not absolutely necessary, since the bucket wheel device 1 has a control system 10 independent of a control center, as illustrated in FIG. 2, and a separate control unit 10*a* and a separate control processor 10*b* are here provided for the bucket wheel device 1. The control system 10 here includes the control unit 10*a*, a separate control processor 10*b* as well as corresponding control conduits 10*c*. The control processor 10*b* is here preferably a plug-in PC and the stockpile shape, especially the surface profile of the stockpile 9 is calculated by way of the control processor 10*b* in dependence of the measurement data of the measurement device 11. The control of the bucket wheel device 1 is carried out in dependence of this surface profile, namely the corresponding signals of the control unit 10*a* are output to the drive system 15. The drive system which is 15 here only schematically illustrated includes the individual controllable components of the bucket wheel device 1, i.e. especially the motors or hydraulic for the lift and swivel mechanism, the travel mechanism as well as for the bucket wheel 6. These components of the drive system 15 are controlled through the control unit 10 by way of the control processor 10*b*. The control processor 10*b* further calculates the position of the bucket wheel device 1, especially the exact position of the bucket wheel 6 relative to the stockpile 9 in dependence of the data from the first and second GPS position receivers 12*a* and 12*b*. The here illustrated control system 10 is preferably realized as a programmable memory control.

A capture of the stockpile shape of the stockpile 9 independent of an operation of the bucket wheel device 1 is possible with the measurement device 11, here realized as a 3-D scanner. Especially by positioning the measurement device 11 at the upper end of the pylon 3 and the realization of the measurement device 11 as a 3-D scanner, no separate measurement pass needs to be carried out and a permanent detection of the stockpile shape of the stockpile 9 is possible even at standstill of the bucket wheel device 1, i.e. independent of its operation. Especially actual changes of the stockpile shape, for example natural downslide processes caused by rain can especially be captured, especially in the direct vicinity of the bucket wheel 6. The control system 10 or the measurement device 11 and the associated components of the control system 10 are constructed in such a way that the stockpile shape is captured in real time. A pass along the stockpile 9 in longitudinal direction is no longer required. The movements or positions of the bucket wheel device 1 and its components, especially the movements of the bucket wheel device 1 about its 3 axes of rotation are captured by way of the GPS system. Because of the positioning of the GPS system, the therewith exactly determinable positioning of the bucket wheel device 1, and a measuring device 11 constructed as a 3-D sensor at the upper end of the pylon 3, the stockpile shape can always be permanently scanned or determined and the generation of a further scanning axis, as with the 2-D scanner known in the prior art, is no longer required. From the measurement data delivered by the measuring device here constructed as a 3-D scanner and the GPS system, the stockpile shape is always actually reproduced by calculation by way of the control system 10, especially the control processor 10*b*.

Figure 4:
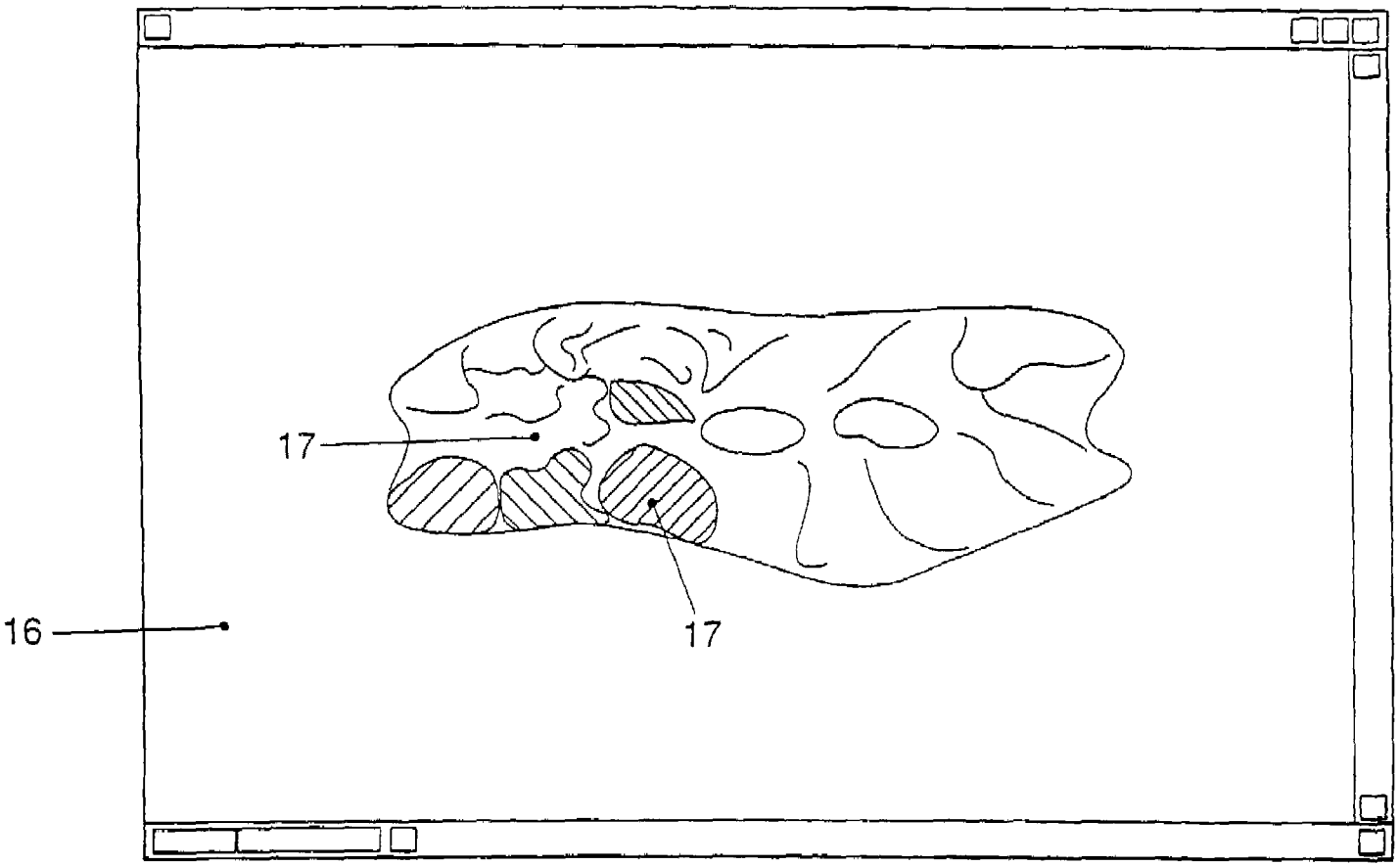

FIG. 4 shows the surface profile of a stockpile 9, which was calculated by way of the control processor 10*b* and reproduced in 2 dimensional color illustration on a screen 16. This illustration has proven very advantageous. Clearly apparent are individual segments 17, preferably illustrated in different color on the screen 16, here partially identified by different hatchings. Such a screen 16 could be provided, for example, in an external control centre, which is provided for the control or supervision of several bucket wheel devices 1. Finally, a tipping protection for the bucket wheel device 1 is realized by way of a tilt angle sensor 14*a* which is preferably also positioned in the upper region of the pylon 3. It has already been mentioned above that the positioning of the bucket wheel 6 of the bucket wheel device 1 is problematic. Because of the large forces acting thereon, a tipping of the whole bucket wheel device 1 can occur upon incorrect positioning of the bucket wheel 6 and if the bucket wheel 6 is not switched off in time. In order to avoid this in particular, a tilt angle sensor 14 is provided which is also connected with the control processor 10*b* or the control unit 10*a* according to circuit technology. When the tilt angle sensor 14*a* determines a certain angle of inclination of the bucket wheel device 1, the operation is immediately halted and especially the bucket wheel 6 is switched off. The measurement data of the tilt angle sensor 14*a* are preferably compared with the measurement data of the GPS system. Thus, on the one hand, the tilt angle sensor 14*a* determines the angle of tilt of the bucket wheel device 1, especially the inclination of the upper portion or part of the bucket wheel device 1, i.e. also the inclination of the jib 2, on the other hand this inclination can also be correspondingly determined by way of the first and second GPS position receivers 12*a* or 12*b* and the control processor 10*b*. When the measurement data deviate from one another, this indicates that either the tilt angle sensor 14*a* or the GPS system do not function normally. In this case, the control system 10 is realized in such a way that the bucket wheel device 1 is also switched off, so that a safety system for the bucket wheel device 1 is realized.

The control system 10 is constructed in such a way that at least a relatively large region can be captured by way of the measurement device 11. Especially a capturing of the actual stockpile shape in the region of the forward jib 2 and a capture of the region in the vicinity of the rearward jib 8 is guaranteed. This results in a corresponding increase in the safety of the operation of the bucket wheel device 1, since actual changes of the stockpile shape in the region of the forward jib 2 are also captured so that the forward jib cannot, for example, bump into "stockpile mountains" and/or the rearward jib 8, especially the conduit 4 provided at the rearward jib 8 can be moved, especially swiveled, without danger. For example, by way of the control unit 10*a* or the control processor 10*b* no swiveling of the forward jib 2 or the rearward jib 8 occurs, for example, when obstructions are detected by way of the control systems 10, especially by way of the measurement device 11, for example in the region of the rearward jib 8 into which the counterweight could bump. This, for example, applies to further shovel vehicles, trucks, or the like, parked in the region of the counterweight 4. Thus, a relatively large region around the bucket wheel device 1 can be "scanned" by way of the measurement device 11, especially since it is located at the upper end of the pylon 3, so that the safety aspect during operation of the bucket wheel device 1 is significantly elevated.

Reference List

1. Bucket wheel device
2. jib
3. pylon
4. counter weight
5. travel mechanism
6. bucket wheel
7. supporting cables
8. rearward jib
9. stockpile
10. control system
10*a* control unit
10*b* control processor
10*c* control conduits
11. measurement device
12*a* first GPS position receiver
12*b* second GPS position receiver
13. conveyor belt
14. sensor elements
14*a* tilt angle sensor
15. drive system
16. screen
17. segments

What is claimed is:

1. A movable bucket wheel device comprising:

a forward jib; and a control system for the automatic control of the moveable bucket wheel device for the reducing of stockpiles and/or the piling up of bulk goods, whereby the bucket wheel device further comprises at least one bucket wheel for pile takeup of bulk goods;

at least one measurement device for the measurement of the stockpile, and the bucket wheel device is automatically moveable to a desired reducing and/or a piling up position dependant on a measured and/or processed measurement data, the control system and the measurement device automatically and continuously monitor and capture an actual stockpile shape without carrying out a measuring pass, whereby the measurement device is a 3-D image capturing system for capturing the stockpile shape in the region of the forward jib to prevent the forward jib from bumping into the stockpile peaks; and a GPS system for capturing of movements and/or positions of the bucket wheel device.

2. The bucket wheel device of claim 1, wherein the bucket wheel device further comprises a rearward jib and said GPS system captures the movement and/or position of the rearward jib.

3. The bucket wheel device claim 1, wherein the bucket wheel device further comprises a pylon and the measurement device is positioned on the pylon.

4. The bucket wheel device of claim 1, wherein the measurement device is a 3-D laser scanner.

5. The bucket wheel device of claim 1, wherein said GPS system comprises a first and a second GPS position receiver for determining the position of the bucket wheel device.

6. The bucket wheel device of claim 5, wherein the first GPS position receiver is positioned on the forward jib and the second GPS position receiver is positioned on the pylon.

7. The bucket wheel device of claim 1, wherein the bucket wheel device further comprises a separate control processor.

8. The bucket wheel device of claim 1, wherein the control system comprises additional sensor elements for the realization of an additional tipping protection for the bucket wheel device.

9. The bucket wheel device of claim 1, further comprising at least one tilt angle sensor.

10. A process for the automatic control of a moveable bucket wheel device comprising the following step:

providing a moveable bucket wheel device according to claim 1, whereby a stockpile shape is captured with the measuring device; and whereby the bucket wheel device is automatically moved to the desired removal and/or piling up position dependant on the measured and/or processed measurement data; wherein a capture of the actual stockpile shape is carried out without carrying out a measurement pass, a capture of the actual stockpile shape is carried out in at least a vicinity of the forward jib to prevent the forward jib from bumping into stockpile peaks, and the movement and/or positions of the bucket wheel device are captured by way of a GPS system.

11. The process of claim 10, wherein a capture of the location of the rearward jib is carried out.

12. The process of claim 10, wherein the measurement device captures the stockpile shape in real time.

13. The process of claim 10, further comprising calculating and reproducing the stockpile shape and location from measurement data from the measurement device and the GPS system.

14. The process of claim 10, wherein a surface profile of the stockpile is calculated with a control processor and output in two dimensional color representation on a screen.

15. The process of claim 10, wherein at least one tilt angle sensor provides a tipping protection for the bucket wheel device by comparison of the data from a tilt angle sensor.

16. A movable bucket wheel device comprising:

a forward jib;

at least one bucket wheel for the take up and/or placement of bulk goods, said bucket wheel connected to the forward jib;

at least one 3D measurement device for the measurement and capture of a stock pile shape;

a GPS system for determining and capturing movements and or positions of the bucket wheel device;

a control system for receiving capture information from the measurement device relating to the shape of the stock pile and for receiving capture information from the GPS system relating to the position of the stock pile;

wherein the bucket wheel device is automatically moveable to a desired position dependant on a measured and or processed measurement data; and wherein a capture of the stockpile shape is determined without a measuring pass; and the forward jib does not bump into the stockpile.

* * * * *